US005361113A

United States Patent [19]

Zander

[11] Patent Number: 5,361,113

[45] Date of Patent: Nov. 1, 1994

[54] PHOTOGRAPHIC FILM PROCESSING ASSEMBLY

[75] Inventor: Dennis R. Zander, Penfield, N.Y.

[73] Assignee: Eastman Kodak Company, Rochester, N.Y.

[21] Appl. No.: 57,025

[22] Filed: May 5, 1993

[51] Int. Cl.[5] ..... G03D 3/08

[52] U.S. Cl. ..... 354/319; 354/320

[58] Field of Search ..... 354/319–323, 354/339, 340, 344, 345; 355/40

[56] References Cited

U.S. PATENT DOCUMENTS

| | | | |
|---|---|---|---|
| 1,863,689 | 6/1932 | Dye . | |
| 2,124,106 | 7/1938 | Dye | 95/89 |
| 2,837,988 | 6/1958 | Pavelle | 95/89 |
| 3,626,831 | 12/1971 | Ealing | 354/319 |
| 4,045,809 | 8/1977 | Landers | 354/322 |
| 4,572,639 | 2/1986 | Mackson | 354/322 |
| 5,093,686 | 3/1992 | Shigaki | 354/354 X |
| 5,162,842 | 11/1992 | Shiota | 355/40 |
| 5,210,561 | 5/1993 | Nakai et al. | 354/297 |
| 5,229,802 | 7/1993 | Shiota et al | 355/77 |
| 5,231,439 | 7/1993 | Takahashi et al. | 354/313 |

FOREIGN PATENT DOCUMENTS

0469594A2 7/1991 European Pat. Off. .

*Primary Examiner*—D. Rutledge

*Attorney, Agent, or Firm*—David A. Hawley

[57] ABSTRACT

A processing rack for holding a plurality of exposed film cartridges from which the respective filmstrips of each cartridge may be unwound to provide full extension thereof to facilitate processing and wound back into the cartridges by selective operation of a reversible drive mechanism that engages the spool of each film cartridge. The rack comprises a plurality of cartridge engaging clamps and elongated guide rods for receiving the respective plurality of cartridges in driving relation with the drive mechanism for unwinding and winding the respective filmstrips from and into each such cartridge. The cartridge engaging clamps are also loosely attached to respective weighted clips which engage the leading end of each of the filmstrips as each such leading end is unwound from the cartridge and are released by thrust forces applied by the leading ends of the filmstrips as they are unwound. The weighted clips each have guide brackets that loosely engage guide rods attached to the respective cartridge engaging clamps so that they move along the guide rods during unwinding. After processing of the filmstrips is complete, they are rewound back into the cartridges, and the leading ends are detached from the weighted clips as they are reengaged by the cartridge engaging clamps.

17 Claims, 5 Drawing Sheets

PHOTOGRAPHIC FILM PROCESSING ASSEMBLY

BACKGROUND OF THE INVENTION

1. Field of the Invention

This invention relates to the field of processing exposed photographic film and more particularly to a method and apparatus for automatically withdrawing an exposed filmstrip from its cartridge, tensioning the withdrawn filmstrip during processing, and rewinding the processed filmstrip into the cartridge for further handling.

2. Description of the Prior Art

Several techniques are employed in processing exposed rolls of positive and negative photographic film on a commercial scale. In a continuous processing method, in a darkroom or enclosure, the exposed filmstrips are withdrawn and severed from the cartridges, spliced together with other exposed filmstrips and slowly drawn through successive developing, rinsing and fixing solutions until processing is complete.

In a further processing method, referred to as "dip and dunk", the exposed filmstrips are withdrawn and severed from the cartridges and clipped at one end to a rack. Weights are attached to the free ends of the filmstrips so that gravity operates to tension the filmstrips as they hang downward from the rack during immersion in the processing solutions. When all of the filmstrips have been attached to the rack and weighted, the rack is successively suspended over the tanks containing the developing, fixing and rinsing solutions and then lowered to lower the weighted filmstrips into each such solution.

The removal of the filmstrips from the cartridges and attachment to the racks, and the attachment of the free hanging weights, requires care and is time consuming. After processing is complete, the removal of the filmstrips from the rack, the weights from the free ends and the handling of the processed filmstrips also require labor.

After either type of processing is complete, in the case of negative film types, the filmstrips may be spliced together or separately drawn through the printing stations of printers in which the images in the frames are exposed onto positive print media from which prints are made. In the case of positive film, the filmstrip image frames may be cut apart and mounted as "slides". Eventually, negative filmstrips are typically cut into envelope sized segments so they can be provided to the consumer within a typical package containing the prints made from the negative images.

Recently, it has been recognized that there are certain advantages to retaining the negative filmstrip with its cartridge through processing and printing, particularly so that it can be protected between these operations and can be returned to the consumer rolled back into the cartridge for safekeeping. For example, European Patent Application 0 469 594 A2 and German OLS P40 38 661.9 both describe a photographic processing, printing and storage method using the dip and dunk processing method, and the spliced-together filmstrip printing method. For processing each filmstrip, these applications describe, in one embodiment, that the cartridge spool is rotated to advance the leading end out of the cartridge aperture, the leading end is automatically gripped, and the filmstrip is pulled out of the cartridge. In at least the '661 application, a weight is attached to the free end and the cartridge is attached to a dip and dunk conveyer so that gravity causes the filmstrip to hang downward as the conveyer moves the filmstrip from tank to tank until processing is complete. The weight is apparently removed, and the processed filmstrip is rewound into the cartridge or severed and spliced for printing. In other embodiments, the exposed filmstrip is severed from the cartridge and continuous processed and printed while the cartridge is retained in order to reattach the processed filmstrip to its spool and rewind it back in.

These processes are complex and do not address certain of the difficulties with the dip and dunk processing method described above.

Problems to be Solved by the Invention

In the dip and dunk processing method, it is generally desirable to increase efficiency and save space by processing a large number of filmstrips simultaneously. In high volume processing, it is desirable to automate the loading of a number of cartridges closely spaced side by side on a rack, while allowing the processing fluids to be circulated vigorously in the solution tank. The use of free hanging weights on the filmstrip free ends helps to maintain tension in the filmstrip, but circulation of the processing solution and swaying movement of the rack and elongated filmstrips may cause contact and entanglement of closely spaced filmstrips. It is thus desirable to insure that the filmstrips of neighboring cartridges are kept under tension and not allowed to contact one another during immersion and withdrawal into and from the successive solutions.

SUMMARY OF THE INVENTION

It is accordingly an object of the present invention to provide a filmstrip and cartridge suspension rack for use in dip and dunk processing that securely tensions the elongated filmstrip and prevents it from curling or contacting adjacent filmstrips while processing solutions are agitated.

It is a further object of the present invention to provide a filmstrip and cartridge suspension rack for use in dip and dunk processing that securely tensions the elongated filmstrip and prevents it from curling or contacting adjacent filmstrips and obviates the need for a weight or element that is manually attached to the leading end of the filmstrip and must later be manually detached.

It is yet another object of the present invention to provide a method and apparatus for automatically attaching a clip to the free end of a filmstrip, withdrawing the filmstrip from a cartridge and guiding the clip along a guide path, and for rewinding the filmstrip back into the cartridge and detaching the clip from the free end thereof after processing is completed.

In accordance with the present invention, a processing rack for holding one or a plurality of film cartridges from which the respective filmstrips of each cartridge may be unwound to provide full extension thereof to facilitate processing and wound back into the cartridges by selective operation of a reversible drive mechanism comprises: at least one or a plurality of cartridge engaging means for receiving the respective plurality of cartridges in driving relation with said drive mechanism for unwinding the filmstrip from and winding the filmstrip into each such cartridge, each cartridge engaging means having first guide means for directing the leading end of each such filmstrip as it is unwound from the cartridge into an engagement position and second guide means for guiding movement of the filmstrip as it is unwound from the cartridge to full extension thereof and wound into the cartridge; and a like plurality of leading end engaging means coupled to said second guide means for attachment to the leading end of each such filmstrip when the leading end thereof is directed into the engagement position and for restraining lateral movement and contact of the elongated filmstrips during extension thereof.

In a preferred embodiment, a processing rack for holding at least one or more film cartridges from which the respective filmstrips of each cartridge may be unwound to facilitate processing and wound back into the cartridges by selective operation of a reversible drive mechanism comprises: at least one or a plurality of cartridge engaging clamps for receiving the respective plurality of cartridges in driving relation with said drive mechanism for unwinding the filmstrip from and winding the filmstrip into each such cartridge, each cartridge engaging clamp having guide means for directing the leading end of each such filmstrip as it is unwound from the cartridge into an engagement position; at least one or a like plurality of clips for attachment to the leading end of each such filmstrip when the leading end thereof is directed into the engagement position; and at least one or a further plurality of elongated guide means extending from the plurality of cartridge engaging clamps for loosely engaging and guiding the weighted clips during further unwinding and extension of the elongated filmstrips from the respective cartridges, whereby, upon full extension thereof, lateral movement and contact of the elongated filmstrips is restrained.

Preferably the clips are provided with retention means for engagement with the respective cartridge engaging clamps which are automatically disengaged by the thrust force of the leading ends of the filmstrips and with filmstrip engagement hooks which engage perforations of the leading end of the filmstrips, as the filmstrips are unwound into the engagement position. The weight of the weighted clips together with the thrust force of unwinding causes the filmstrips to be extended from the film cartridges along the second guide means.

Upon rewinding of the filmstrips, the clips are returned to the engagement position, the retention hooks of the respective cartridge engaging clamps engage the clips, and the filmstrip engagement hooks disengage from the leading ends of the filmstrips.

Advantages and Effects of the Invention

Thus, the invention provides for the extension of a plurality of filmstrips from a like plurality of rack mounted film cartridges without relying on free hanging weights. The cartridges are automatically unwound and wound, and the leading ends thereof are automatically attached to and detached from a guiding mechanism that tensions the extended filmstrips and restrains lateral movement, twisting and contact between adjacent filmstrips. The restraint allows the processing solutions to be agitated to shorten processing time. The loading, unwinding, processing, rewinding and unloading of the film cartridges may be done automatically and efficiently.

BRIEF DESCRIPTION OF THE DRAWINGS

These and other objects, advantages and features of the invention will be apparent from the following detailed description of the accompanying drawings, in which like elements are denoted by like numerals, and in which.

DETAILED DESCRIPTION OF THE PREFERRED EMBODIMENTS

As is well known in the art 35 mm film cartridges contain a filmstrip that is wound about and attached at one end to a rotatable spool and has a free or leading end exposed through an elongated slit in the sidewall of the cartridge. To facilitate exposure of image frames in a camera, the free or leading end of the filmstrip is attached to a camera spool, and the filmstrip is unwound a frame at a time until all exposures are made. Then, the exposed filmstrip is rewound back onto the spool in the cartridge and provided to a photo-finisher to make prints or slides. The leading end of the filmstrip is typically rewound inside the cartridge, but may be thrust back out the light-tight elongated aperture by rotating the cartridge spool that is engageable from the end of the cartridge.

The present invention is preferably practiced with a 35 mm "thrust" cartridge having a cartridge spool and internal filmstrip guides that allows the leading end of the filmstrip to be driven out of the elongated filmstrip aperture on rotation of the spool in the unwind direction. Such a cartridge is disclosed in commonly assigned U.S. Pat. No. 5,173,730 to David Dieterich et al and incorporated herein by reference.

Figure 1:
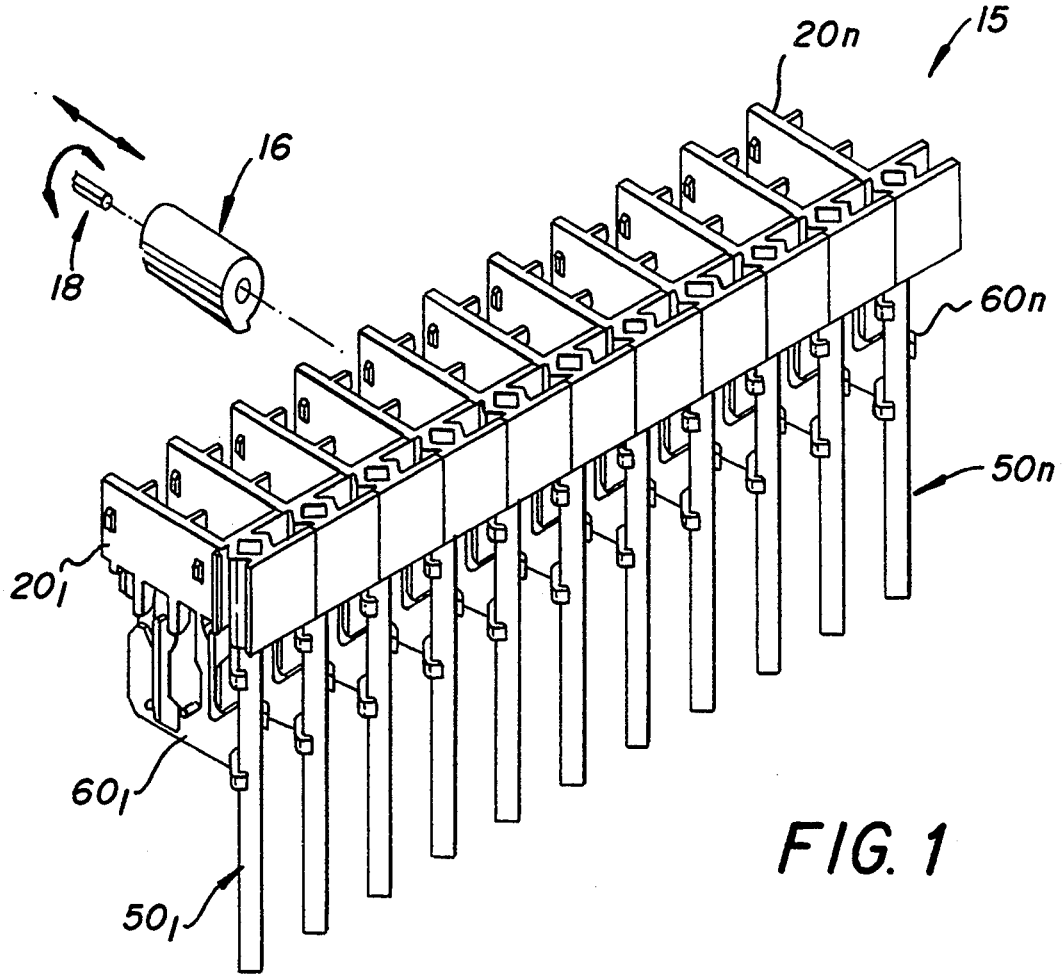
FIG. 1 is a perspective view of an unloaded rack for suspending a plurality of filmstrips extended from their respective cartridges in a film processing solution.

Turning first to FIG. 1, it depicts a processing rack 15 for holding a plurality of exposed film cartridges, e.g. cartridge 16, from which the respective filmstrips of each cartridge may be unwound to provide full extension thereof to facilitate processing and wound back into the cartridges by selective operation of a reversible drive mechanism that engages the spool of each film cartridge (shown schematically in one drive position) as drive motor and spool engaging shaft 18. The rack 15 comprises a plurality of cartridge engaging clamps $20_1$–$20_n$ for receiving the respective plurality of n cartridges in driving relation with the drive mechanism for unwinding and winding the n respective filmstrips from and into each such cartridge. The individual cartridge engaging clamps $20_i$, depicted in FIGS. 2–5, are attached together with the other components described hereafter to form the rack 15.

The cartridge engaging clamps $20_1$–$20_n$ each are fixedly attached to respective guide rods $50_1$–$50_n$ which are of a length sufficient to accomodate the standard 12, 24 and 36 exposure frame filmstrip lengths when unwound to full extension alongside the guide rods. For convenience of illustration, the lengths of the guide rods $50_1$–$50_n$ are truncated in the various figures.

Figure 10:
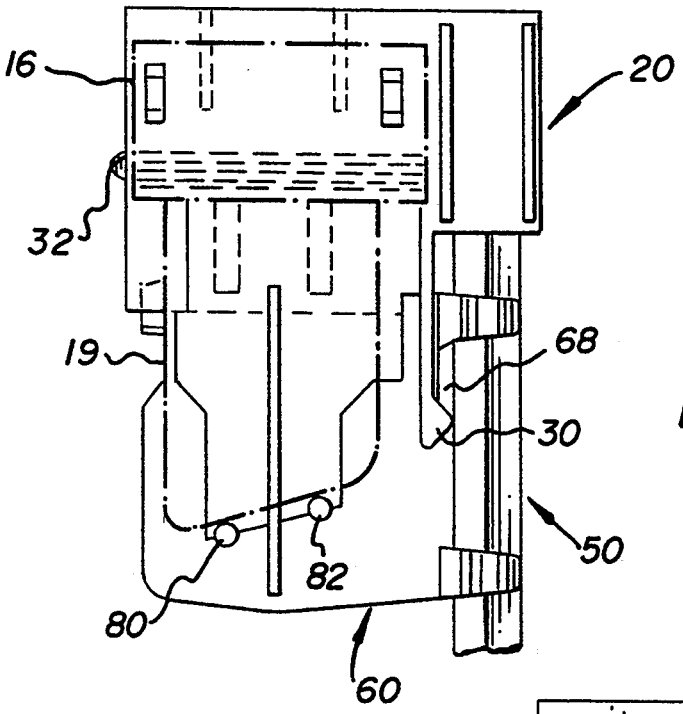
FIG. 10 is a front view of a film cartridge loaded into a cartridge retaining clamp and with the filmstrip being unwound so that its leading end is in engagement with the weighted clip.

The cartridge engaging clamps $20_1$–$20_n$ are also loosely attached to respective weighted clips $60_1$–$60_n$ (shown in detail in FIGS. 6–9) which engage the leading end 19 of each of the n filmstrips as each such leading end 19 is unwound from the cartridge 16 into an engagement position also shown in FIG. 10. In the engagement position, the weighted clips $60_1$–$60_n$ are retained by the cartridge engaging clamps $20_1$–$20_n$ but may be released by thrust forces applied by the leading ends 19 of the filmstrips as they are unwound and directed out of the light tight apertures of the film cartridges 16. Simultaneously, the weighted clips $60_1$–$60_n$ are automatically attached to the free ends of the filmstrips and tension the filmstrips as they are fully unwound and rewound. The weighted clips $60_1$–$60_n$ each have guide brackets 62, 64, 66 that loosely engage the guide rod so that they move along the guide rods $50_1$–$50_n$ during unwinding. After processing of the filmstrips is complete, they are rewound back into the cartridges, and leading ends 19 are detached from the weighted clips $60_1$–$60_n$ as they are re-engaged by the cartridge engaging clamps $20_1$–$20_n$.

The cartridge engaging clamps $20_1$–$20_n$ are further illustrated in FIGS. 2–5. Each clamp 20 has front, side and bottom sections that receive a film cartridge 16 (not shown) with its elongated aperture directed downward. The front section includes a front wall 22 that is attached to guide rod engaging side section 24 having a square cross-section, tubular receptacle for receiving one end of a guide rod 50. Elongated bars 26 and 28 snap fit and may be cemented into matching receptacles 26' and 28' formed in the opposite ends of each side section 24 to form the rack 15 shown in FIG. 1.

Figure 11:
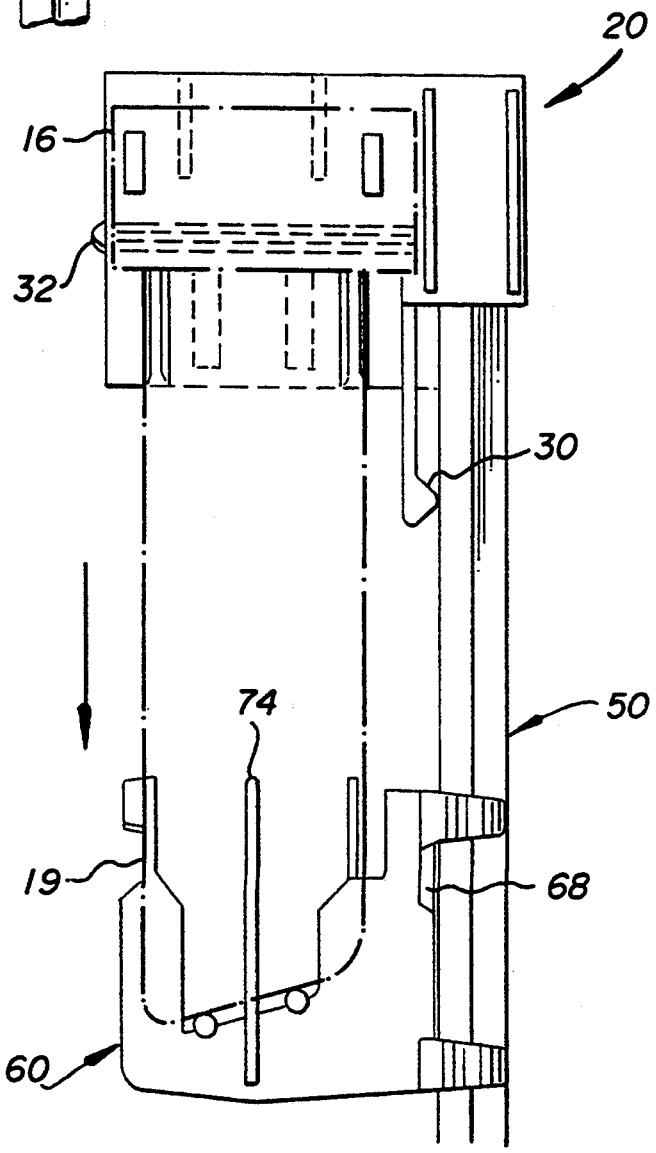
FIG. 11 is a front view of the film cartridge loaded into the cartridge retaining clamp and with the filmstrip being unwound toward full extension with its leading end engaged by the weighted clip and guided by a guide rod.
Figure 12:
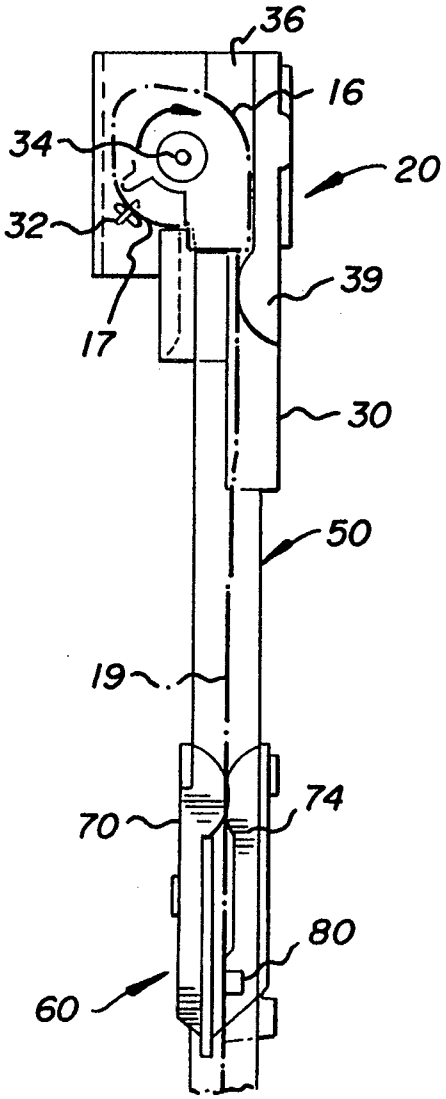
FIG. 12 is a side view of the film cartridge loaded into the cartridge retaining clamp and with the filmstrip being unwound toward full extension with its leading end engaged by the weighted clip and guided by a guide rod.

A first elongated hook 30 extends downward to engage a weighted clip 60 when it is in the position shown in FIGS. 1 and 10. A second elongated hook 32 extends from the side section 24 into engagement with the end rim and a pinwheel cut-out in one end of the cartridge 16 that rotates with the spool, as shown in FIG. 10, to both retain the cartridge and prevent rotation of the spool. During unwinding and rewinding operations, a mechanism associated with the driving motor and spool engaging shaft 18 pulls the end of hook 32 out of engagement with the pinwheel cut-out. A centering post 34 fits in the central spool aperture of the film cartridge 16 to position it in place with its aperture aligned downward as shown in FIGS. 10–12.

Figure 2:
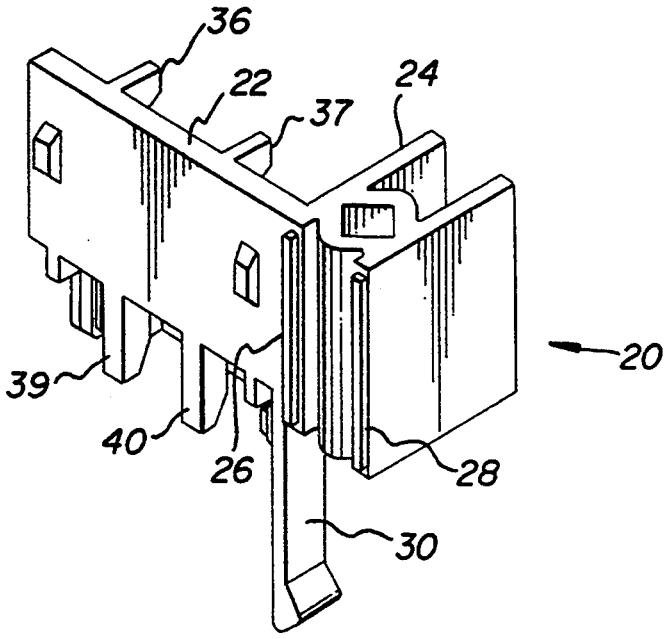
FIG. 2 is a perspective view of a film cartridge engaging clamp employed in the rack of FIG. 1.
Figure 4:
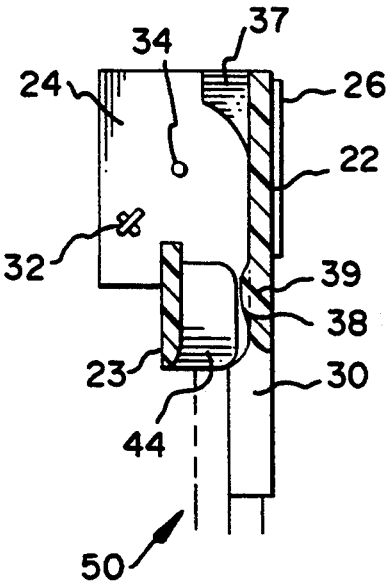
FIG. 4 is an end cross-section view of the clamp of FIG. 5 taken along line A—A.
Figure 5:
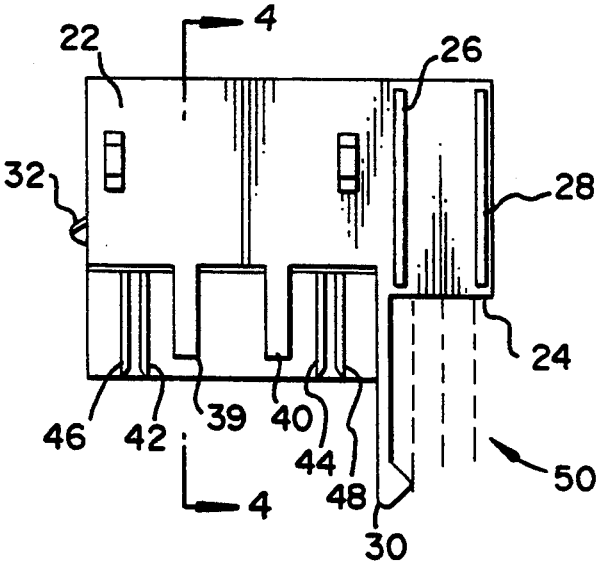
FIG. 5 is a front view of the clamp of FIG. 2.
Figure 6:
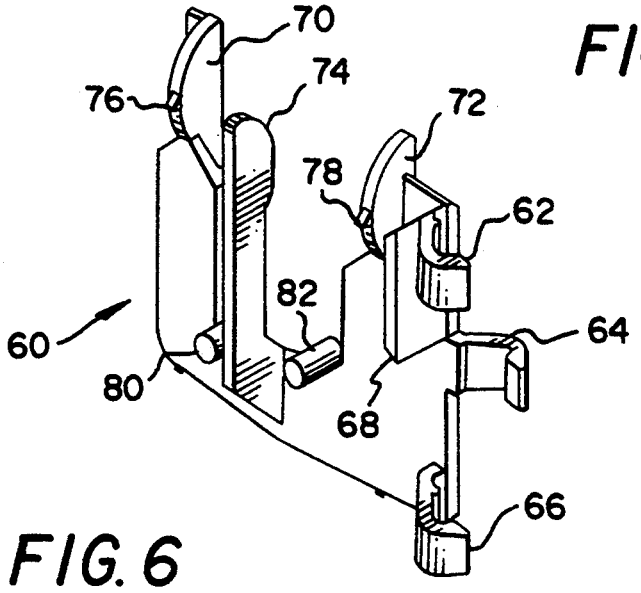
FIG. 6 is a perspective view of a film engaging weighted clip employed in the rack of FIG. 1.

As shown in the perspective view of FIG. 2 and the side cross-section view of FIG. 4, upper cartridge braces 36 and 37 extend inward from front wall 22 and also restrain rotation of the cartridge 16 fitted into the clamp 20. An elongated section 23 extends from side section 24 and is attached to front wall 22 at its extended end and supports film plane defining structure. The entire film clamp 20 may be molded of a single piece of plastic.

Figure 3:
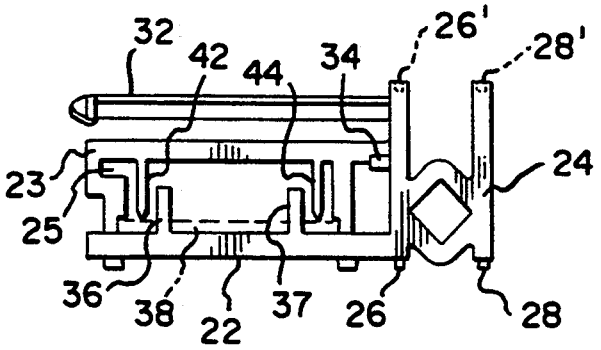
FIG. 3 is a top view of the clamp of FIG. 2.

Thus, when a cartridge 16 is inserted into the clamp 20, the cartridge aperture is directed downward and aligned with a film plane 38, shown in FIGS. 3 and 4, having a narrow thickness and a width sufficient to accommodate 35 mm film. The film plane 38 is bounded by upper filmstrip guides 39 and 40 extending downward from the elongated section 23 to bear against one surface of the filmstrip and lower filmstrip guides 42 and 44 extending downward from front wall 22 to bear against the other surface of the filmstrip, which collectively define the width of film plane 38. Filmstrip edge guides 46 and 48 extending from elongated section 23 define the width of the film plane 38. This set of guides bounding the film plane 38 acts to guide the leading end of the filmstrip downward toward the engagement position with the weighted clip 60 when the filmstrip is thrust out of the aperture of the cartridge 16 and restrain movement of the filmstrip during other unwinding and rewinding operations.

The weighted clip 60, shown in FIGS. 6–9, has three guide brackets 62, 64, 66 that partially and loosely surround the guide rod 50 to ride up and down the rod when the weighted clip 60 is attached to the leading end of a filmstrip as shown in FIGS. 10–13. The weighted clip 60 is retained in the engagement position by the first elongated hook 30 that catches under the beveled edge 68 of the tab adjacent the guide bracket 62 and is released when downward force applied by the advancing leading end 19 of the filmstrip on the weighted clip 60 overcomes the spring bias of the hook 30.

Figure 7:
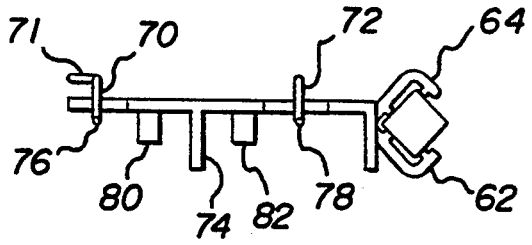
FIG. 7 is a top view of the clip of FIG. 6.
Figure 8:
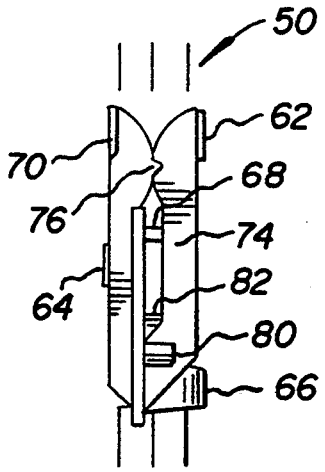
FIG. 8 is an end view of the clip of FIG. 6.
Figure 9:
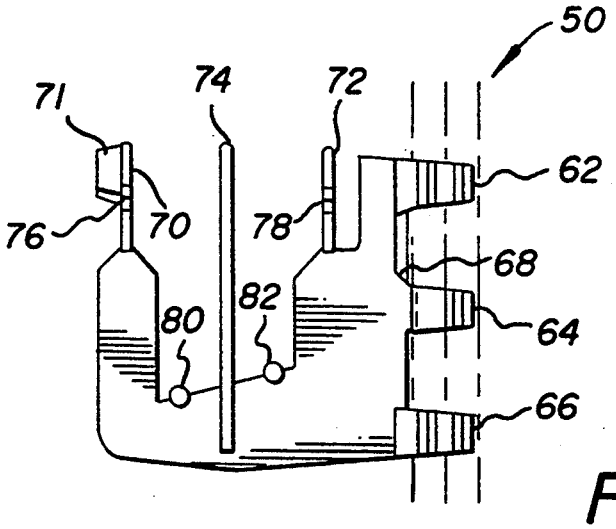
FIG. 9 is a front view of the clip of FIG. 6.

The weighted clip 60 is provided with a pair of upwardly extending film cam surfaces 70 and 72 facing inward and a third upwardly extending cam surface 74 facing inward between and toward the cam surfaces 70 and 72. The cam surfaces 70 and 72 are provided with film sprocket hole engaging hooks or picks 76 and 78, respectively. A pair of stops 80 and 82 extend outwardly, on either side of the junction of the cam surface 74 and the body of the weighted film clip 60. As shown in FIGS. 7 and 8, the cam surfaces 70, 72 and picks 76, 78 on one side of the body of the weighted clip 60 extend toward and dimensionally overlap the inwardly facing cam surface 74, although they do not contact one another. The cam surface 70 is also provided with a tab 71 that is received in the space 25 formed by the elongated section 23 as shown in FIG. 3.

Turning to FIGS. 10–13, various positions of a filmstrip cartridge 16 and leading end 19 are depicted in relation to a cartridge engaging clamp 20, guide rod 50 and weighted clip 60. In these figures, the cartridge 16 is exposed for view through the front wall 22 and certain of the above described structure of the cartridge engaging clamp 20 and the weighted clip 60 are depicted in dotted lines for reference.

In FIG. 10, the film cartridge 16 is shown fitted into the cartridge receptacle of the cartridge engaging clamp 20, and the leading end 19 of the filmstrip is extended through the film plane 38 between the overlapping, upwardly extending cam surfaces 70, 72, 74 and into abutment with the stops 80, 82 of the weighted clip 60. As the leading end 19 is thrust further out of the cartridge 16, the force it applies against the stops 80, 82 overcomes the retention force of the first hook 30. At the same time, the picks 76, 78 are forced into filmstrip sprocket holes so that as the weighted clip is released by the hook 30, it is attached and retained.

In FIGS. 11 and 12, the leading end 19 is shown attached to the weighted clip 60 as the filmstrip continues to be unwound. The downward movement through continued unwinding of the filmstrip is facilitated by the weight of the weighted clip which tensions the filmstrip. The loose attachment of the weighted clip to the rod by the encircling brackets 62, 64, 66 restrains twisting and lateral movement of the filmstrip, so adjacent filmstrips do not become entangled during agitation of the processing solutions.

When the filmstrip is fully unwound, the motor 18 is retracted from the spool of the cartridge and the drive motor or the rack is repositioned to the next cartridge insertion and drive position. The end of filmstrip may be detected by the detection of a special perforation in the filmstrip (not shown) that becomes aligned with an optical sensor (not shown) located in the cartridge insertion and drive position. Other detection systems may be employed, e.g. a motor drive clutch that disengages the motor drive shaft when resistance to further rotation of the film cartridge spool is encountered at the end of the filmstrip.

In any case, when the drive motor and spool engaging shaft 18 is retracted, the end of hook 32 snaps into the pinwheel cut-out 17 of cartridge 16 and blocks rotation of the cartridge spool.

Returning to FIG. 1, the rack 15 may be suspended on a tracking mechanism that laterally moves it with respect to a film cartridge loading and magazine and the drive motor and spool engaging shaft 18 so that film cartridges may be successively loaded onto the cartridge engaging clamps $\mathbf{20_1}$–$\mathbf{20_n}$, and the filmstrips be successively unwound and extended alongside the respective guide rods $\mathbf{50_1}$–$\mathbf{50_n}$ as described above. After all of the cartridges are loaded and the filmstrips are unwound, a mechanized system may move the loaded racks and the downwardly extending filmstrips over, downward, into processing solutions, and upward in a "dip and dunk" fashion until the processing steps are completed and the filmstrips are dried. Thereafter, the rack may be moved to a rewind station and indexed past a rewind motor and spool engaging shaft, which may be shaft 18, to successively rewind the filmstrips back into the cartridges. Before doing so, the hook 32 is released from attachment to the pinwheel cut-out 17 by a mechanism (not shown) associated with the rewind motor and spool engaging shaft.

Figure 13:
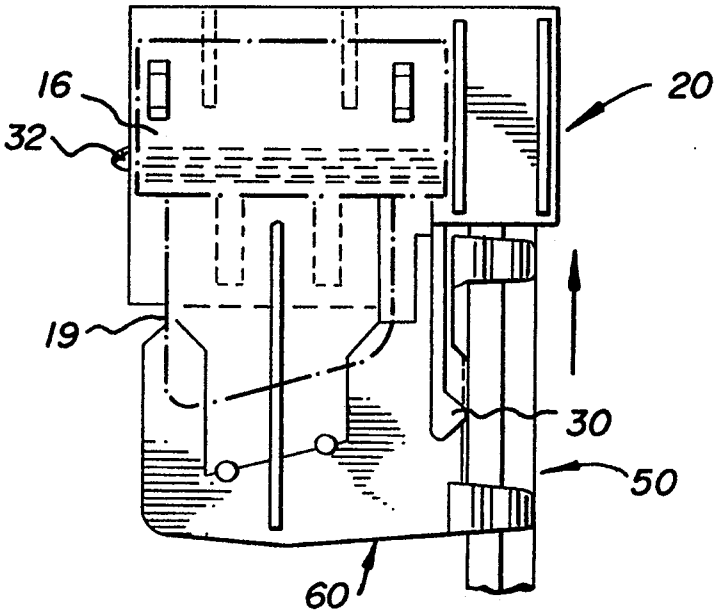
FIG. 13 is a front view of the film cartridge loaded into the cartridge retaining clamp and with the filmstrip being rewound back into the cartridge after release of its leading from the weighted clip.

In FIG. 13, the final stage of rewinding of the leading end 19 of the filmstrip into the cartridge 16 is illustrated. At this point, the weighted clip 60 has been drawn back up the guide rod 50. The leading end 19 of the filmstrip has pulled the weighted clip 60 upward past the first elongated clip and the inwardly extending cam surfaces 70, 72, 74 are drawn against the upper and lower filmstrip guides 39–44 and spread apart, thereby releasing the filmstrip sprocket perforations from the picks 76, 78. The leading end 19 is then fully rewound into the cartridge 16 and the cartridge is ejected from the film engaging clamp 20.

Although the preferred embodiment described above contemplates a processing rack having a plurality n of the cartridge engaging clamps 20, guide rods 50 and weighted clips 60, in a further preferred embodiment, where n=1, the invention may be employed to withdraw and restrain lateral movement and twisting of a single filmstrip for processing. Furthermore, in such a processor, the separate solution tanks may be replaced by a tubular processing enclosure that the filmstrip may be extended in, and the enclosure may be filled and emptied of the processing and rinsing solutions to effect processing of the filmstrip.

The preferred embodiments of the invention described above employs weighted clips operating with the force of gravity to facilitate unwinding and tensioning of the filmstrip during extension and rewinding. It will be understood that the weight may vary from negligible to significant enough to itself unwind the filmstrip. It will also be understood that other forces than gravity, e.g. springs, may be employed to tension and aid in unwinding the filmstrips, particularly in applications involving non-vertical orientation of the guide rods and filmstrips.

The invention having been described in detail with particular reference to certain preferred embodiments thereof will be understood to encompass variations and modifications thereof and equivalents thereto within the spirit and scope of the invention defined by the appended claims.

PARTS LIST FOR FIGS. 1–13 processing rack 15
film cartridge 16
pinwheel cut-out
drive motor and spool engaging shaft 18
leading end 19
cartridge engaging clamps $\mathbf{20_1}$–$\mathbf{20_n}$
front wall 22
elongated section 23
rod engaging side section 24
space 25
elongated bars 26 and 28
matching receptacles 26' and 28'
first elongated hook 30
second elongated hook 32
centering post 34
upper cartridge braces 36 and 37
film plane 38
upper filmstrip guides 39 and 40
lower filmstrip guides 42 and 44
filmstrip edge guides 46 and 48
guide rods $\mathbf{50_1}$–$\mathbf{50_n}$
weighted clips $\mathbf{60_1}$–$\mathbf{60_n}$
guide brackets 62, 64, 66
beveled edge 68
upwardly extending film cam surface 70 and 72
tab 71
third upwardly extending cam surface 74
film sprocket hole engaging hooks or picks 76 and 78
stops 80 and 82

What is claimed is:

1. A processing rack for holding a plurality of film cartridges from which the respective filmstrips of each cartridge may be unwound to provide full extension thereof to facilitate processing and wound back into the cartridges by selective operation of a reversible drive mechanism, the processing rack comprising:

a plurality of cartridge engaging means for receiving the respective plurality of cartridges in driven relation with said drive mechanism for unwinding the filmstrip from and winding the filmstrip into each such cartridge, each cartridge engaging means having first guide means for directing the leading end of each such filmstrip as it is unwound from the cartridge into an engagement position and second guide means for guiding movement of the filmstrip as it is unwound from the cartridge to full extension thereof and wound into the cartridge; and a like plurality of leading end engaging means coupled to said second guide means for attachment to the leading end of each such filmstrip when the leading end thereof is directed into the engagement position and for restraining lateral movement and contact of the elongated filmstrips during extension thereof.

2. The processing rack of claim 1 further comprising:

a plurality of second guide means each extending from a respective cartridge engaging means in side by side orientation for loosely engaging and guiding the leading end engaging means during further unwinding and extension of the elongated filmstrips from the respective cartridges.

3. The processing rack of claim 2 further comprising:

means associated with said cartridge engaging means and said leading end engaging means for automatically attaching the leading end engaging means to the leading ends of the filmstrips when the leading ends thereof are unwound into the engagement position

4. The processing rack of claim 3 further comprising:

means for detaching the leading end engaging means from the leading end of the filmstrips and attaching the detached leading end engaging means to the respective cartridge engaging means as the filmstrips are rewound back into the film cartridges.

5. The processing rack of claim 1 further comprising:

means associated with said cartridge engaging means and said leading end engaging means for automatically attaching the leading end engaging means to the leading ends of the filmstrips when the leading ends thereof are unwound into the engagement position.

6. The processing rack of claim 5 further comprising:

means for detaching the leading end engaging means from the leading end of the filmstrips and attaching the detached leading end engaging means to the respective cartridge engaging means as the filmstrips are rewound back into the film cartridges.

7. The processing rack of claim 1 further comprising:

means for detaching the leading end engaging means from the leading end of the filmstrips and attaching the detached leading end engaging means to the respective cartridge engaging means as the filmstrips are rewound back into the film cartridges.

8. A filmstrip handling method for use in conjunction with a processing rack for holding at least one film cartridge of the type having a filmstrip contained therein and attached at one end to and wound about a rotatable filmstrip spool and having a leading end which may be extended through an elongated cartridge aperture and through which the filmstrip may be unwound to provide full extension thereof to facilitate processing and rewound back into the respective cartridge by selective rotation of the spool within the cartridge, comprising the steps of:

positioning each respective cartridge in an engaging clamp in driving relation with drive mechanism for engaging the cartridge spool and unwinding the filmstrip from and rewinding the filmstrip into each such respective cartridge;

directing the leading end of each such filmstrip as it is unwound from the cartridge into an engagement position;

automatically attaching a weighted film clip to the leading end of the filmstrip when the leading end is unwound into the engagement position; and guiding further movement of the weighted film clip as the filmstrip is unwound from the cartridge to full extension thereof and is rewound into the cartridge.

9. The method of claim 8 wherein said automatic attaching step further comprises:

detaching the weighted clip from the cartridge engaging clamp when the leading end of the filmstrip thereof is unwound into the engagement position; and further comprising the step of:

detaching the weighted film clip from the leading end of the filmstrip and attaching the detached weighted clip to the respective engaging clamps as the filmstrip is rewound back into the film cartridge.

10. Filmstrip handling apparatus for use in conjunction film processing for holding at least one film cartridge of the type having a filmstrip contained therein and attached at one end to and wound about a rotatable filmstrip spool and having a leading end which may be extended through an elongated cartridge aperture and through which the filmstrip may be unwound to provide full extension thereof to facilitate processing and rewound back into the respective cartridge by selective rotation of the spool within the cartridge by a selectively operable drive mechanism, wherein said apparatus further comprises a film cartridge handling rack comprising at least one cartridge and film handling assembly comprising:

cartridge engaging means for receiving the cartridge in driven relation with said drive mechanism for unwinding the filmstrip from and winding the filmstrip into the cartridge, the cartridge engaging means having first guide means for directing the leading end of the filmstrip as it is unwound from the cartridge into an engagement position;

second guide means for guiding movement of the filmstrip as it is unwound from the cartridge to full extension thereof and rewound into the cartridge; and leading end engaging means coupled to said second guide means for attachment to the leading end of the filmstrip when the leading end thereof is directed into the engagement position and for restraining lateral movement of the elongated filmstrip during extension thereof.

11. The film handling assembly of claim 10 wherein said cartridge engaging means further comprises:

a cartridge engaging clamp for engaging a respective film cartridge and adapted to be positioned in driven relation with said drive mechanism for engaging the cartridge spool and unwinding the filmstrip from and rewinding the filmstrip into each such positioned cartridge, said cartridge engaging clamp supporting said first guide means for directing the leading end of each such filmstrip as it is unwound from the cartridge into an engagement position; and said leading end engaging means further comprises a film clip having:

first means for attaching the film clip to the leading end of the filmstrip when the leading end thereof is unwound into the engagement position;

means for engaging said second guide means for guiding further movement of the film clip as the filmstrip is unwound from the cartridge to full extension thereof and is rewound into the cartridge; and second means for attaching the detached clip to the cartridge engaging clamp as the filmstrip is rewound back into the film cartridge.

12. The apparatus of claim 11 wherein said second guide means further comprises:

an elongated guide rod extending from the cartridge engaging clamp a predetermined distance; and said engaging means further comprises:

at least one bracket coupled to the clip for loosely engaging the elongated guide rod and guiding the clip along the guide rod during further unwinding and rewinding of the elongated filmstrip from and into the film cartridge.

13. The apparatus of claim 12 wherein said cartridge engaging clamp further comprises:

a clip engaging hook for detachably engaging the clip; and said second attaching means further comprises:

means for detaching the clip from the hook when the leading end of the filmstrip thereof is unwound into the engagement position and for attaching the clip to the hook when the filmstrip is rewound into the cartridge.

14. The apparatus of claim 13 wherein said first attaching means further comprises:

a filmstrip engaging hook for engaging a perforation of the leading end of the filmstrip, as the filmstrip is unwound into the engagement position.

15. The apparatus of claim 11 wherein said first attaching means further comprises:

means for detaching the clip from the cartridge engaging clamp when the leading end of the filmstrip thereof is unwound into the engagement position.

16. The apparatus of claim 11 wherein said cartridge engaging clamp further comprises:

a clip engaging hook for detachably engaging the clip; and said second attaching means further comprises:

means for detaching the clip from the hook when the leading end of the filmstrip thereof is unwound into the engagement position and for attaching the clip to the hook when the filmstrip is rewound into the cartridge.

17. The apparatus of claim 16 wherein said first attaching means further comprises:

a filmstrip engaging hook for engaging a perforation of the leading end of the filmstrip, as the filmstrip is unwound into the engagement position.

* * * * *